US005273605A

United States Patent [19]

Mitchell

[11] Patent Number: 5,273,605

[45] Date of Patent: Dec. 28, 1993

[54] SYSTEM FOR FABRICATING A CONVOLUTELY WOUND TUBE

[76] Inventor: Mark Mitchell, 1197 Piney Ridge Rd., Dalton, Ga. 30721

[21] Appl. No.: 828,108

[22] Filed: Jan. 30, 1992

Related U.S. Application Data

[62] Division of Ser. No. 615,161, Nov. 19, 1990, Pat. No. 5,100,496.

[51] Int. Cl.[5] ..... B31F 1/07; B31C 13/00

[52] U.S. Cl. ..... 156/209; 156/218; 156/183; 493/303

[58] Field of Search ..... 156/218, 209, 205, 203, 156/183, 446; 493/303, 304; 264/282, 287, 286; 425/369, 336, 385

[56] References Cited

U.S. PATENT DOCUMENTS

| | | | |
|---|---|---|---|
| 267,326 | 11/1882 | Childs . | |
| 623,695 | 4/1899 | Arkell | 264/286 |
| 1,550,084 | 8/1925 | Lorenz | 156/183 |
| 2,409,249 | 10/1946 | Brown . | |
| 2,901,951 | 9/1959 | Hochfeld | 264/287 |
| 2,915,109 | 12/1959 | Walton | 425/369 |
| 3,188,372 | 6/1965 | Roos | 264/287 |
| 3,220,057 | 11/1965 | Walton | 425/385 |
| 3,566,925 | 3/1971 | Sagara et al. | 138/143 |
| 3,613,738 | 7/1969 | Witzig | 138/156 |
| 3,983,905 | 10/1976 | Witzig | 138/156 |
| 4,153,664 | 5/1979 | Sabee | 264/282 |
| 5,060,349 | 10/1991 | Walton | 264/282 |

*Primary Examiner*—Michael W. Ball
*Assistant Examiner*—Daniel J. Stemmer
*Attorney, Agent, or Firm*—Hopkins & Thomas

[57] ABSTRACT

An improved system for fabricating convolutely wound tubes includes a supply roll support for supporting a large supply of paperboard, an adhesive applicator for receiving paperboard from the supply roll and applying a coating of adhesive to one side thereof, a cutting station for cutting the paperboard across its length to form sheets of paperboard, and a winding station including a mandrel about which cut sheets of adhesive bearing paperboard are wound into a tubular configuration. As the paperboard is drawn from the supply roll, one of its edges passes sequentially through three corrugating nip rolls, which alternately deform the material of the edge to render it more pliable and flexible. This flexible edge, then, becomes the trailing edge of paperboard sheets that are wound into tubes such that the edge can be easily conformed to the contour of and adhered to the outer surface of the finished tube.

1 Claim, 4 Drawing Sheets

FIG 4
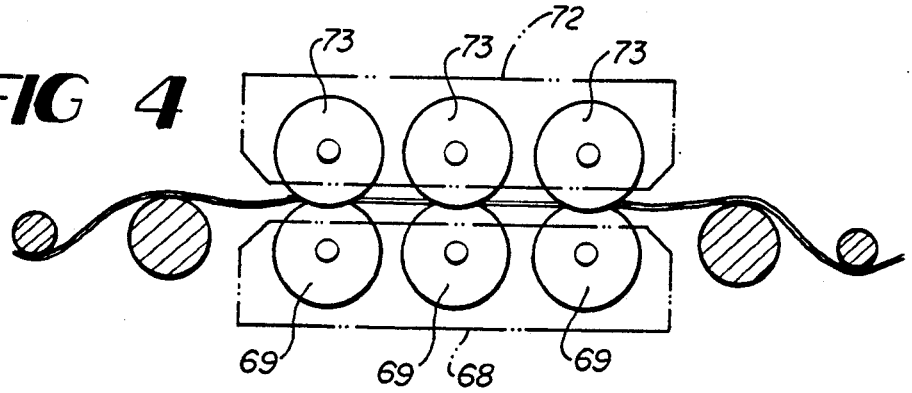
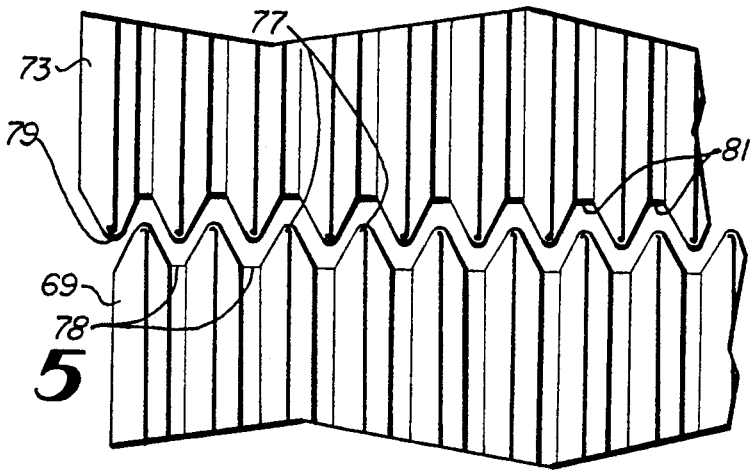
FIG 5
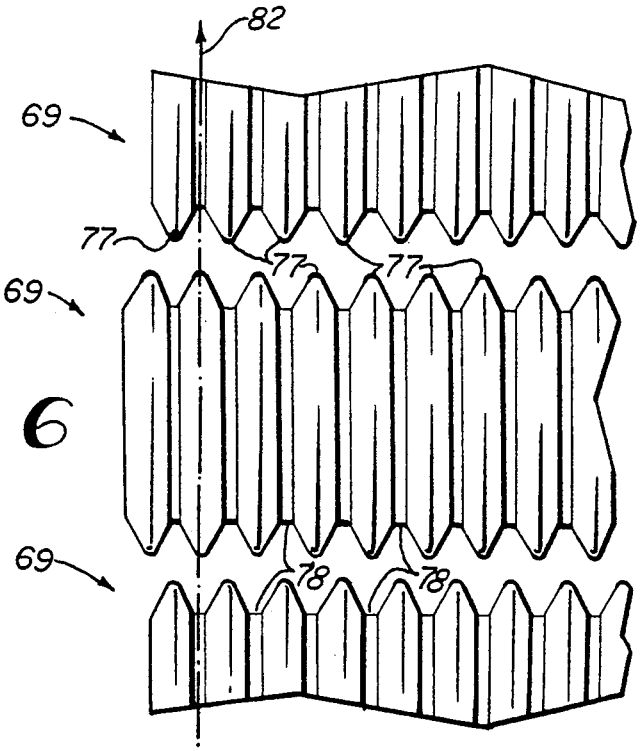
FIG 6

SYSTEM FOR FABRICATING A CONVOLUTELY WOUND TUBE

CROSS REFERENCE

This is a division of U.S. patent application Ser. No. 07/615,161 filed Nov. 19, 1990, now U.S. Pat. No. 5,100,496.

TECHNICAL FIELD

This invention relates generally to convolutely wound tubes of the type about which lengths of carpet and other lengths of sheet material are wound for storage, and more particularly to systems for fabricating such tubes.

BACKGROUND OF THE INVENTION

Convolutely wound tubes are commonly employed as cores about which extended lengths of carpet, paper, and other sheet material are wrapped into large spiral wound rolls for transport and storage. Such tubes typically are fabricated by drawing paperboard from a large supply reel, moving it along its length through an adhesive applicator, cutting it across its length to form a sheet of paperboard, securing one edge of the paperboard sheet in the longitudinal slot of a cylindrical mandrel, and rotating the mandrel to wind the paperboard about the mandrel into an elongated tubular configuration. The adhesive bonds successive layers of the tube walls securely together providing a convolutely wound paperboard tube that is economical to produce and that exhibits strength and bending resistance superior in some instances to more expensive spiral wound and other types of tubes.

The just described process has been employed for many years in the fabrication of convolutely wound tubes. Although the process has proven satisfactory, it nevertheless has long been plagued with a persistent problem that heretofore has evaded a satisfactory solution. Specifically, the thickness and rigidity of the paperboard from which tubes are wound tends to cause the trailing edge of the paperboard sheet to resist conforming to the outside contour of the tube and to spring away from the tube after the tube is wound. The adhesive that is applied to the paperboard generally has insufficient holding capacity to secure this trailing end in place as the adhesive cures.

Prior solutions to this persistent problem generally have included treatment of the trailing edge of the sheet prior to winding of the trailing end of the sheet onto the tube to render the edge more pliable or flexible and thus more easily conformable and securable to the outer surface of the tube. One widely accepted solution employees a sanding device known as a skiver having a moving abrasive belt that rides on an edge of the paperboard material as it is drawn from its supply roll. The sanding belt abrasively removes material from the edge of the paperboard to render the edge significantly thinner and thus much more pliable and conformable than it otherwise would be. This sanded flexible edge then becomes the trailing edges of subsequently cut sheets that are wound about the mandrel into tubes with the enhanced pliability rendering the edge more conformable and adhesively securable to the outer surface of the tube.

While skivers have proven somewhat successful in the fabrication of convolutely wound tubes, they nevertheless have had inherent problems and shortcomings of their own. The paperboard material abraded away by the skiver, for example, typically takes the form of a fine paper dust that must be collected and discarded by means of large and expensive cyclone type vacuum systems coupled to remove paperboard dust from the skivers to satisfy EPA standards. In addition, since finished tubes are graded by weight, discarding the paper dust is tantamount to discarding product itself and, after long periods of operation, can result in significant waste. Skivers can also produce high levels of noise during operation and in some instances can require special measures to insure that noise levels fall within OSHA standards. Further, the abrasive sanding belts of the skivers also tend to wear out, which necessitates down time of the tube winding system for belt replacement. Finally, if the paperboard being drawn from its supply roll becomes twisted or if the line is stopped for a significant time, the belt of the skiver can and often does sand completely through the paperboard material. This obviously generates waste and can even cause jamming of the paperboard at subsequent stations of the winding system.

Another attempt at rendering the trailing edge of paperboard sheets conformable to the tube contour has included mechanically deforming the trailing edges into a corrugated configuration prior to tube winding so that the corrugated edge can wrap about the contour of and can be adhesively secured to the finished tube. Such a technique is disclosed in U.S. Pat. No. 3,983,905 of Witzig. While this technique can be adequate, it nevertheless has proven to be an incomplete solution. The corrugated shape of the trailing edge, for example, can be unacceptable in instances where a smooth surfaced tube is required. Further, the alternating ridge and groove configuration of the corrugated trailing edge reduces the area of the trailing edge that becomes juxtaposed the facing surface of the tube and therefore reduces the available area of contact between the corrugated trailing edge and the tube so that the adhesive tend to be only marginally sufficient to secure the edge to the tube. As a result, the edge can and sometimes does pull away from the tube to create an undesirable flap that can interfere with use of the tube.

Thus, it is seen that a continuing and heretofore unsolved need exists for an improved system of fabricating convolutely wound tubes from paperboard sheets that insures conformability and securability of the trailing edges of the sheets to the outer surface of the tubes while avoiding the inherent problems and shortcomings of prior art systems as discussed hereinabove. It is to the provision of such a system that the present invention is primarily directed.

SUMMARY OF THE INVENTION

The present invention comprises an improved system for fabricating convolutely wound tubes whereby the trailing edge of paperboard sheets from which tubes are wound is rendered flexible and pliable so as to conform easily to the cylindrical outer contour of their tubes for adhesive securement thereto. The system includes a supply roll support for supporting a large supply roll of paperboard, an adhesive applicator for receiving paperboard from the supply roll and applying a coating of adhesive to one surface thereof, a cutter for cutting the paperboard across its length to form sheets of paperboard, and a winding station including a rotatably driven mandrel about which cut sheets of adhesive bearing paperboard are wound into a tubular configuration.

Supported on a frame between the supply roll support and the adhesive applicator is a roll stand that has three corrugating nip rolls arranged for successive movement of an edge of paperboard therethrough as it is drawn from its supply. Each of the corrugating nip rolls deforms the paperboard's edge in a corrugated pattern extending parallel to the paper's edge. The ridges of the intermediate nip roll, however, are offset relative to the ridges of the leading and trailing nip rolls such that as the edge of the paperboard moves successively through the nip rolls, it is corrugated along a first array of lines by the leading nip roll, recorrugated along a second array of lines offset from the first array by the intermediate nip roll, and finally recorrugated again along a different third array of lines by the trailing nip roll. The cumulative effect of the successive offset corrugations is to destroy the rigidity of the paperboard along its edge rendering the edge highly flexible and pliable. The edge is not, however, permanently deformed by the nip rolls but rather remains flat and coextensive with the rest of the paperboard.

The pliable edge, then, becomes the trailing edges of the subsequently cut sheets that are wound about the mandrel into tubes with the now pliable trailing edges conforming readily to the cylindrical outer contour of their tubes for adhesive securement thereto.

Thus, it is seen that an improved system for fabricating convolutely wound tubes is now provided that overcomes the problems and shortcomings of prior art systems. Specifically, the trailing edges of paperboard sheets are rendered highly pliable and conformable to the contour of their tubes without noisy, expensive and wasteful abrasive sanding of such edges. Furthermore, the pliability of the paperboard edge is achieved without permanently deforming the edge as with prior art corrugating techniques thus resulting in a convolutely wound tube with a smooth securely bound exterior surface. The trailing edge is also more securely adhered to the tube since its full surface area engages the surface of the tube for adhesive securement thereto.

It is thus an object of the invention to provide an improved system for fabricating convolutely wound tubes that eliminates the need for a skiver.

A further object of the invention is to provide a system for fabricating convolutely wound tubes wherein the trailing edges of paperboard sheets from which tubes are wound are rendered pliable without sanding or permanent deformation.

A still further object of the invention is to provide a quiet, reliable and economical method of rendering the trailing edges of paperboard sheets pliable prior to the sheets being formed into convolutely wound tubes.

These and other objects, features and advantages of the invention will become more apparent upon review of the following detailed description taken in conjunction with the accompanying drawings.

BRIEF DESCRIPTION OF THE DRAWINGS

FIG. 4 is a side elevational view of the three vertically opposed corrugating roll pairs and the lease bars showing movement of paperboard therebetween.

FIG. 5 illustrates the mutually meshed relationship of the ridged cylindrical outer surfaces of opposed corrugating nip rolls.

FIG. 6 is a top elevational view of three of the spaced rolls showing the longitudinal offset of the center roll with respect to the end rolls.

DETAILED DESCRIPTION

Figure 1:
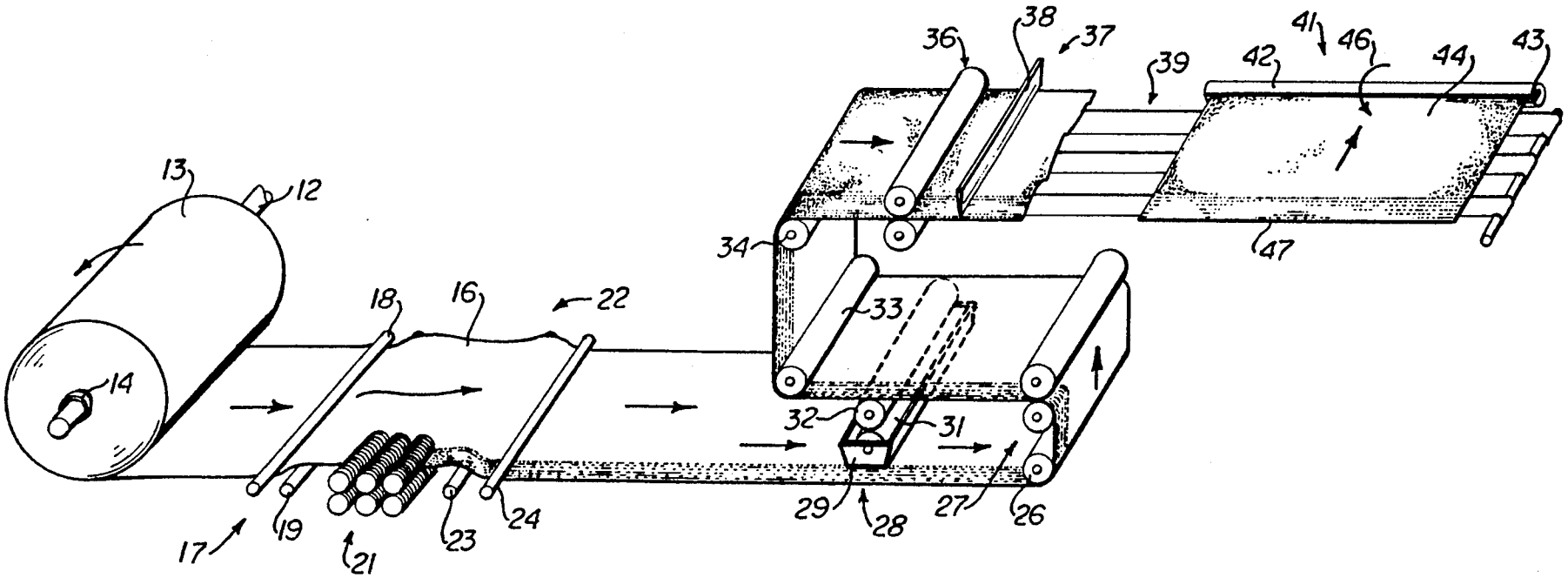
FIG. 1 is a schematic perspective view of a convolutely wound tube fabrication system that embodies principles of the present invention in a preferred form.

Referring now in more detail to the drawings, in which like numerals refer to like parts throughout the several views, FIG. 1 illustrates in perspective schematic a system for fabricating convolutely wound tubes that embodies principles of the present invention in a preferred form. The system 11 is seen to comprise a supply roll support 12 for rotatably supporting a large rolled supply 13 of paperboard from which tubes are to be convolutely wound. (While paperboard will be referred to herein as the foundational material of wound tubes, it will be understood that other suitable sheet materials such as plastic might be substituted where appropriate. The term "paperboard" should, therefore, be understood to include any suitable sheet material for fabricating convolutely wound tubes.)

The supply roll support 12 comprises an elongated shaft that extends loosely through the central passageway of the supply roll 13. A stop 14 is secured to the shaft on either side of the supply roll to prevent unintentional longitudinal shifting of the roll during operation of the system. Paperboard can thus be drawn from the roll, which rotates about its support in response.

Positioned in the path of paperboard drawn from the supply roll 13 is a first pair of lease bars 17, a nip roll assembly 21 including three pairs 21A, 21B & 21C of corrugating nip rolls positioned for movement of an edge of the paperboard sequentially therethrough, and a second pair of lease bars 22. The lease bar pairs 17 and 22 are positioned on opposite sides of the corrugating nip roll assembly 21 for loosely securing the paperboard and aligning its edge for sequential movement through the pairs of nip rolls as it is drawn from the supply roll. The first lease bar pair comprises a leading bar 18 and a trailing bar 19 that are oriented and secured in spaced parallel relationship with respect to each other on the upstream side of the nip roll assembly 21 for receiving and aligning the paperboard as shown. Similarly, the second lease bar pair comprises spaced parallel bars 23 and 24 for receiving and aligning the paperboard on the downstream side of the nip rolls 21.

Each of the sequentially arranged corrugating nip rolls of the nip roll assembly 21 comprises a pair of vertically opposed rolls with each roll having a circumferentially grooved or corrugated outer surface as described in more detail below. The pairs of nip rolls of the roll assembly 21 normally are positioned in compressive engagement with the edge portion of the paperboard to deform the edge in three successive different configurations as it moves sequentially through nip roll pairs. In this regard, the intermediate nip roll pair is offset with respect to the leading and trailing nip roll pairs so that the three nip roll pairs sequentially deform or corrugate the paper's edge along a first plurality of lines parallel to the paper's edge, thence along a second plurality of lines that are laterally displaced relative to the first plurality of lines, and finally along a third plurality of lines that are laterally displaced from the second plurality of lines. In this way, the rigidity of the edge of the paperboard is destroyed to render the edge pliable and flexible. This flexible edge, however, is not permanently deformed but rather emerges from the nip roll assembly 21 in a substantially flat configuration coextensive with the rest of the paperboard 16.

With an edge of the paperboard rendered pliable as discussed, the paperboard moves in the indicated direction around a first guide roll 26 thence through a feed roll assembly 27 and past an adhesive applicator 28, which applies a smooth coating of adhesive to one side of the paperboard. Specifically, the adhesive applicator 28 includes a reservoir 29 for containing a supply of adhesive. A transfer roll 31 is rotatably secured within the reservoir 39 and is adapted to rotate and thereby draw adhesive from the reservoir and transfer it to an applicator roll 32 that is rotatably secured in vertically opposed relationship to the transfer roll 31. The applicator roll 32, then, receives adhesive from the transfer roll and applies it to the moving paperboard 16, which passes over and engages the applicator roll 32 in the indicated direction.

With the adhesive thus applied, the paperboard moves around a pair of guide rolls 33 and 34, through a feed roll assembly 36 and to a cutting station 37. The cutting station 37 includes a blade 38 for cutting the paperboard transversely across its length to form individual sheets of paperboard for winding into tubes. The feed roll assembly 36 is adapted to be intermittently driven to pass predetermined lengths of paperboard through the cutting station 37 for cutting with such predetermined lengths corresponding to the length of convolutely wound tubes to be fabricated. Once cut, a sheet of paperboard is moved by a conveyor 39 or other suitable transfer means to a winding station 41 for winding the sheet in convolute fashion about itself to form the finished tube.

The winding station 41 includes an elongated cylindrical mandrel 42 that is formed with a longitudinally extending slot 43 for receiving the leading edge of the paperboard sheet as it is transferred into the winding station 41. With the sheet 44 in position at the winding station with its edge secured within the slot 43 of the mandrel 42, the mandrel 42 is rotated by a suitable drive means (not shown) in the direction indicated at 46. Such rotation draws the sheet 44 tightly about the mandrel 42 in a spiral wrapped, convolutely wound configuration with the adhesive binding successive layers of the tube wall securely together. In this regard, it should be noted that the adhesive applicator 28 can be arranged to apply adhesive beginning a predetermined distance from the leading edge of the sheets to avoid the adhesive's coming into contact with and contaminating the mandrel as tubes are wound.

As the pliable edge 47 of the sheet 44 approaches and is wrapped about the tube by the rotating mandrel, its pliability and flexibility as a result of having passed through the corrugating nip roll assembly renders it highly conformable to the cylindrical exterior surface of the tube. The adhesive is thus readily able to secure the trailing edge to the tube so that the edge does not tend to spring away from the tube under the influence of the paper's rigidity. A finished convolutely wound tube thus is formed with a smooth, non-corrugated outer surface having an edge that is neatly conformed and securely adhered to the exterior surface of the tube.

Once wound and secured, the finished tube can be slipped off the mandrel 42 and transferred to successive stations or to storage in preparation for movement of the next successive sheet of paperboard to the winding station 41 for fabrication of another convolutely wound tube as described.

Figure 2:
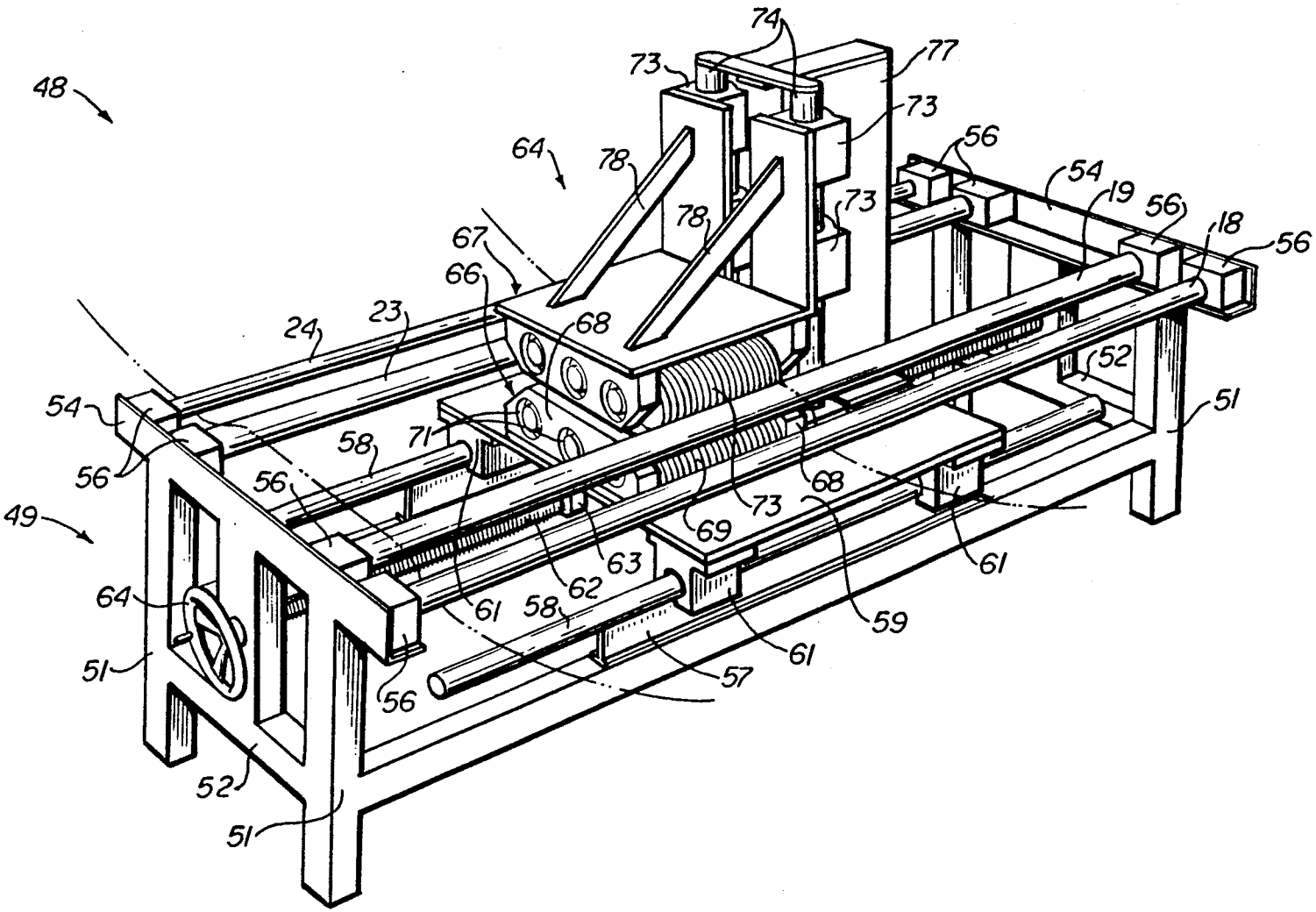
FIG. 2 is a perspective view illustrating a preferred embodiment of an apparatus for rendering a paperboard edge pliable prior to its being cut into sheets and wound into tubes.

FIGS. 2–6 detail an apparatus for rendering an edge of the paperboard pliable which such apparatus embodying principles of the present invention in a preferred form. Referring to FIG. 2, the apparatus 48 is seen to include a frame 49 that is preferably fabricated of welded metal to support the functional elements of the device on a floor. The frame 49 includes four vertically extending legs 51 interconnected intermediate their ends by lateral brace members 52 and longitudinal brace members 53. A pair of opposed cradles 54 are disposed and secured at the top of opposite ends of the frame 49. Pilar blocks 56 are secured within the cradles 54 and are positioned and adapted to receive and secure the ends of elongated lease bars 18, 19, 23, and 24 such that the lease bars extend in mutually spaced parallel relationship straddling central elements of the apparatus as best seen in FIG. 2.

Mounted atop each of the longitudinal brace member 53 is a shaft support rail 57 that supports a bearing shaft 58 extending longitudinally of the apparatus. A carriage 59 includes a set of four depending linear bearings 61 that are adapted to mate with and slide with low friction along the bearing shafts 58. In this way, the carriage 59 is easily movable along the length of the apparatus 48 by virtue of the linear bearings 61 supported upon the bearing shafts 58. A travel screw 62 threadably extends through a screw block 63 that depends from the under side of the carriage 59 with the travel screw 62 extending along the length of the apparatus and terminating at one end in a rotational crank 64. The crank 64 can thus be rotated to move the carriage 59 and its associated functional elements along the length of the apparatus for selective adjustment of the longitudinal position of such functional elements for adjusting the nip roll assembly to accommodate specific widths of paperboard.

Securely mounted atop the carriage 59 is a roll stand 64 that includes a lower roll assembly 66 and an upper roll assembly 67 positioned in mutual vertical opposition. The lower roll assembly 66 has a pair of spaced, upstanding bearing blocks 68 between which are rotatably secured a set of three cylindrical rolls 69 (FIG. 4) with each roll 69 having a circumferentially grooved or corrugated outer surface. The ends of each roll 69 are secured within bearings 71 that are in turn mounted within the bearing blocks 68 for ease of rotation of the grooved rolls 69.

Similarly, the upper roll assembly 67 includes a pair of spaced depending bearing blocks 72 that rotatably support a set of three upper rolls 73 (FIG. 4) with each upper roll having a grooved outer surface corresponding to the grooved surfaces of the lower rolls 69. Each roll of the upper roll assembly is mounted in vertical opposition to a corresponding roll of the lower roll assembly.

Figure 3:
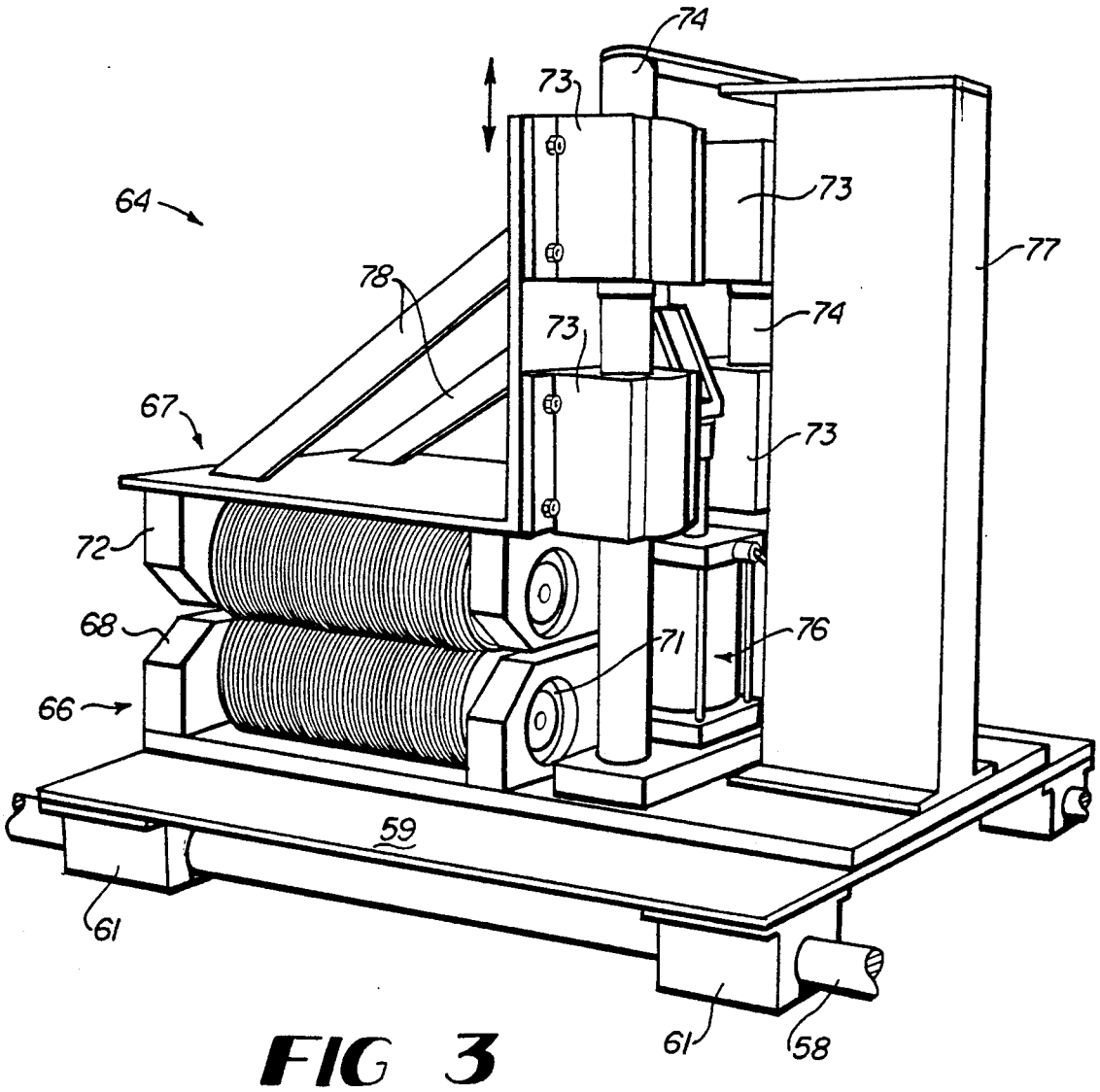
FIG. 3 is a perspective view of the roll stand assembly of this invention showing the lower roll assembly and the opposed vertically movable upper roll assembly.

As best seen in FIG. 3, the upper roll assembly 67 is selectively vertically movable toward and away from the lower roll assembly 66 by means of a set of linear bearings 73 mounted to a pair of spaced vertically extending bearing shafts 74. A pneumatic cylinder 76 is coupled between the base of the roll stand and the upper roll assembly and can be actuated selectively to raise the upper assembly 67 away from the lower assembly 66, or to lower the upper assembly 67 toward engagement with the lower assembly 66 to bring the grooved surfaces of opposed rolls into mutually meshed cooperating engagement for treatment of paperboard. In this configuration, corresponding upper and lower rolls define the three sequential corrugating nip roll pairs 21A, 21B, and 21C illustrated in FIG. 1. A vertical support member 77 and a pair of diagonal brace member 78 insure that the rolls are maintained in secure compressive relationship with paperboard that moves through the rolls.

When the upper roll assembly is in its lowered operative position, its rolls and the rolls of the lower roll assembly form the corrugating nip roll assembly 21 as illustrated in FIG. 1. The selective vertical movability of the upper roll assembly 67 allows for convenient threading of the paperboard through the apparatus 48 with its edge extending between the upper and lower roll assemblies whereupon the roll assemblies can be brought together into compressive relationship with the paper's edge.

FIGS. 5 and 6 illustrate details of the grooved or corrugated surfaces of the rolls 69 and 73 and their working spacial relationships with respect to each other. The scale of sizes of these details has been exaggerated somewhat in FIGS. 5 and 6 for clarity. It will be understood, however, that actual sizes of the features of the preferred embodiment are smaller than they appear in FIGS. 5 and 6 but that their function is as described hereinbelow. In this regard, it has been found that a spacing between ridges of approximately 0.2 inches, a groove depth of approximately 0.12 inches and a groove wall angle of approximately 60 degrees are acceptable and function well with most paperboard materials from which tubes are wound.

FIG. 5 illustrates one of the three corrugating nip roll pairs showing a portion of a lower roll 69 and a corresponding portion of an upper roll 73 as they appear when in their mutually meshed operative positions for treatment of paperboard. The lower roll 69 is seen to be formed with a circumferentially grooved or corrugated outer surface characterized by a plurality of spaced ridges 77 separated by troughs 78. Similarly, the upper roll 73 has an outer surface characterized by a corresponding set of ridges 79 and troughs 81. In the preferred embodiment, the troughs 78 and 81 are formed with a somewhat flattened bottom and the tips of the ridges 77 and 79 are formed to be somewhat rounded. While the flattened trough bottoms result primarily from the type of machining tool typically used to cut the ridged surfaces of the rolls, the rounded tips of the ridges serve to allow some slippage of paperboard longitudinally with respect to the rolls as it moves therebetween and thus to aid in the prevention of binding of the paperboard by the rolls.

With an upper and lower roll in the operative positions as shown in FIG. 5, the ridges of the upper roll 73 extend partially into the troughs of the lower roll 69 and vice-versa. In this way, as paperboard moves between the rolls, its edge is deformed in a repetitive saw tooth or corrugated fashion along a plurality of lines extending parallel to the edge. This tends to disrupt the paperboard's substrate and at least partially destroy the rigidity thereof along the paperboards edge.

FIG. 6 illustrates the spacial relationships of the grooves of the three sequential corrugating nip rolls when viewed from the top in FIG. 2. Reference numeral 82 in FIG. 6 denotes a line extending longitudinally in the direction of paperboard movement through the respective nip rolls. As can be seen, the ridges of the middle nip roll is transversely offset from the outer nip rolls such that the ridges of the outer surface of the middle nip roll align longitudinally in direction 82 with the troughs of the inner and outer nip rolls. In this way, the edge of the paperboard is scored or corrugated along a first plurality of lines as it passes through the first corrugating nip roll pair and thence along a second plurality of lines displaced from the first plurality of lines as it passes through the second corrugating nip roll pair. Finally, the paperboard is again corrugated along a third plurality of lines that correspond to the first plurality of lines as it passes through the third corrugating nip roll pair before passing on to the adhesive applicator and subsequent stations of the system.

The result of this successive displaced corrugative deformation is that the paperboard edge is alternately bent or flexed along a plurality of lines extending parallel with the edge of the paperboard. This flexing has the effect of destroying the rigidity of the edge of the paperboard thus rendering it pliable and conformable without permanently deforming or corrugating the edge as with prior art methods. The treated paperboard can then be drawn through successive stations of the system as discussed above and wound into a convolute tube with the pliable edge becoming the trailing edge of cut sheets so as to conform to the outer contour of the tube and be securely adhered thereto by the adhesive. The result is a superior convolutely wound tube with a smooth securely bound outer surface similar to tubes formed with expensive and troublesome sanding techniques employed in the past.

The invention has been described in terms of a preferred embodiment. It will be obvious to those of skill in the art, however, that many modifications, additions and substitutions might be made to the illustrated embodiment within the intended scope of the invention. While it has been found, for example, that three pairs of opposed corrugating nip rolls are preferred, fewer or greater numbers of nip roll pairs might well be employed with similar results. Further, while a particular configuration of the adhesive applicator, cutting station, and winding station have been illustrated, it should be understood that many other configurations might be employed, the preferred embodiment being intended only as an exemplary configuration. These and other modifications, deletions and additions might be made to the illustrated embodiment without departing from the spirit and scope of the invention as set forth in the claims.

I claim:

1. A method of fabricating convolutely wound tubes from paperboard comprising:

advancing paperboard along its length from a supply;

as the paperboard is advanced, moving the paperboard between first and second pairs of nip rolls, each including an upper roll having alternate annular ridges and troughs and a lower roll having alternate annular ridges and troughs, with the ridges of the lower nip rolls projecting into the troughs of the upper nip rolls and the troughs of the lower nip rolls receiving the ridges of the upper nip rolls wherein the ridges and troughs of said second nip roll pair are transversely offset from the ridges and troughs of said first nip roll pair, whereby an edge of the paperboard is deformed in a first direction upon movement through the first nip roll pair and subsequently deformed in a second direction opposite to the first direction so that the edge portion becomes pliable and conformable to the cylindrical surface of a convolutely wound tube formed of the paperboard, applying adhesive to at least one surface of the paperboard;

cutting the paperboard across its length to form individual sheets of paperboard; and convolutely winding the cut adhesive-bearing sheets of paperboard into elongated tubes.

* * * * *